United States Patent [19]

Simpson

[11] Patent Number: 4,947,597

[45] Date of Patent: Aug. 14, 1990

[54] WINDOW MOUNTING ASSEMBLY

[75] Inventor: Ralph G. Simpson, Hendersonville, Tenn.

[73] Assignee: Western Reserve Plastics, Gallatin, Tenn.

[21] Appl. No.: 435,978

[22] Filed: Nov. 13, 1989

[51] Int. Cl.[5] ..... E06B 1/30; E06B 5/00

[52] U.S. Cl. ..... 52/208; 52/397; 52/398; 52/458; 52/775

[58] Field of Search ..... 52/397, 400, 455, 457, 52/458, 474, 716, 718, 208, 398, 399, 775

[56] References Cited

U.S. PATENT DOCUMENTS

| | | | |
|---|---|---|---|
| 1,849,412 | 3/1932 | Strong | 52/716 |
| 3,230,677 | 1/1966 | Brown | 52/208 |
| 3,363,390 | 1/1968 | Crane | 52/716 |
| 3,438,166 | 4/1969 | Bakke | 52/400 |
| 3,443,346 | 5/1969 | Eggert | 52/400 X |
| 3,455,080 | 7/1969 | Meadows | 52/716 X |
| 3,503,168 | 3/1970 | Eggert | 52/208 |
| 3,707,816 | 1/1973 | Van Wuyckuyse | 52/400 X |
| 3,760,543 | 9/1973 | McAllister | 52/397 |
| 3,903,669 | 9/1975 | Pease, Jr. et al. | 52/455 |
| 4,018,022 | 4/1977 | Fink | 52/400 X |
| 4,259,818 | 4/1981 | Stark | 52/208 |
| 4,407,105 | 10/1983 | Frank | 52/397 |
| 4,753,056 | 1/1988 | Pacca | 52/716 X |
| 4,850,168 | 7/1989 | Thorn | 52/455 X |

FOREIGN PATENT DOCUMENTS

| | | | |
|---|---|---|---|
| 570114 | 2/1959 | Canada | 52/400 |
| 872571 | 6/1971 | Canada | 52/397 |

*Primary Examiner*—Richard E. Chilcot, Jr.
*Assistant Examiner*—Deborah McGann Ripley
*Attorney, Agent, or Firm*—Harpman & Harpman

[57] ABSTRACT

A window mounting assembly for the flush mounting of door lights or the like. The mounting assembly utilizes a pair of reversible female extrusions joined to a male extrusion secured within the mounting article. The male and female extrusions have dual durometer surfaces and flanges as sealing means between each other, the door, and the door light.

4 Claims, 2 Drawing Sheets

WINDOW MOUNTING ASSEMBLY

BACKGROUND OF THE INVENTION

1. Technical Field:

This device relates to the mounting of glass panes or the like in mounting frames in doors known as door lights in entry doors.

2. Description of Prior Art:

Prior Art devices of this type have used a variety of common construction practices including the traditional use of wood moldings and glazing or the more recent practice of molded plastic frames. The plastic frames secured to one another by screws clamping the frames onto the exterior edge surface of an opening in a door with the window pane held between the frames. The plastic frames have most recently been used on modern metal doors typically having a thin metal skin filled with expanded resin foam for strength and insulation value, see for example U.S. Pat. Nos. 4,259,818, 3,760,543, and 3,903,669.

In U.S. Pat. No. 4,259,818 a tamper proof window unit is disclosed that secures a window frame in a door. The frame members extend outwardly over and down the adjacent exterior surfaces of the door to discourage removal of the frame and the window glass positioned therein.

U.S. Pat. No. 3,903,669 discloses a mounting assembly for snap together complimentary molding members. Each molding member has projecting studs that receive a connector member that secure the molding members together on the outside peripheral edge of the opening.

In U.S. Pat. No. 3,760,543 a door light unit is disclosed having a pair of oppositely disposed identical mounting frame members that are joined together on a window pane and the outer peripheral edge of the door adjacent the door light opening by a clamping action between registering pins.

SUMMARY OF THE INVENTION

A window mounting assembly for the flush mounting of door lights or the like within a door. The mounting assembly uses oppositely disposed identical extruded members to secure a window pane therebetween and to a registering extrusion secured within an opening in the door. Both the extrusions use dual durometer surfaces of yieldable material to form assembly gasket surfaces between the window pane, the door and each other. The registering extrusion is positioned in the door during fabrication.

DESCRIPTION OF THE PREFERRED EMBODIMENT

Figure 4:
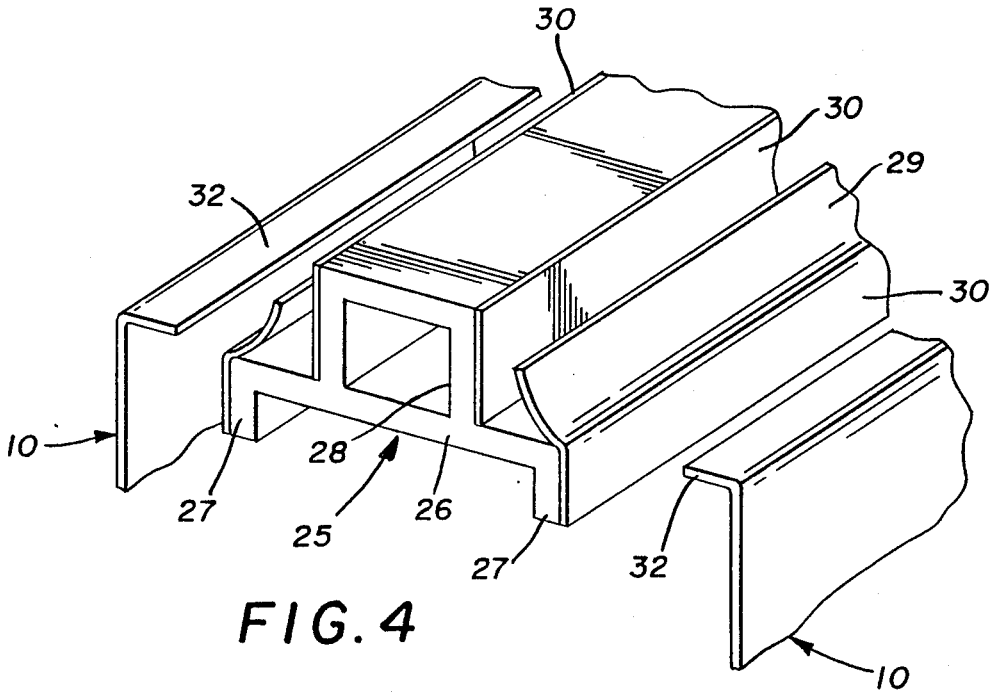
FIG. 4 is an exploded perspective view showing the assembly of the mounting extrusion within the door at point of fabrication.
Figure 5:
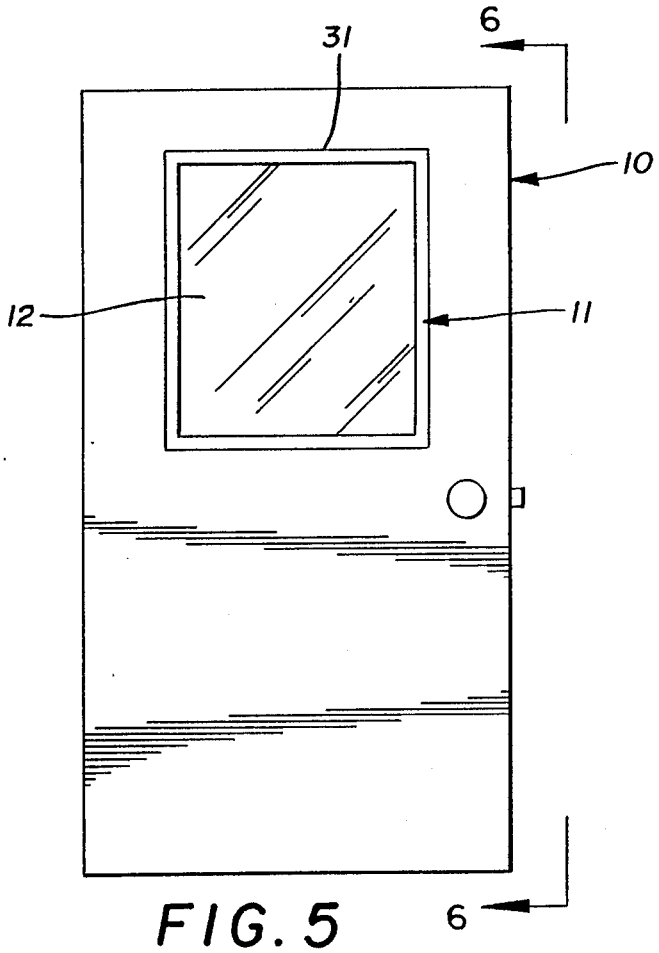
FIG. 5 is an external view of a door with an assembled door light within.
Figure 6:
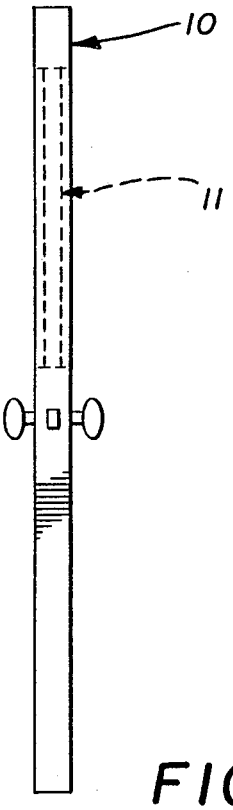
FIG. 6 is an end view on lines 6—6 of FIG. 5.

In FIGS. 5 and 6 of the drawings a door 10 can be seen having a door light assembly 11 positioned flush within. The door light assembly 11 comprises a window pane 12 held within a two-part molding mounting frame 13. Referring now to FIGS. 1–4 of the drawings the molding mounting frame 13 is comprised of a pair of oppositely disposed identical plastic resin extrusion members 14 which when secured together by a fastener form a continuous glass engagement channel 15 for the mounting of the window pane 12 therebetween. Each of the extrusion members 14 best seen in FIG. 3 of the drawings has an inner surface 16 and an outer contoured surface 17. An alignment and fixation rib 18 extends from the inner surface 16 and has a longitudinally extending V-shaped groove 19 within. A caulking groove 20 is formed within a vertically ascending surface 21 of the inner surface 16 defining with the rib 18 a portion of the glass engagement channel 15 as hereinbefore described. A portion of the vertically ascending surface 21 above the caulking groove 20 is formed on its surface by a dual durometer of a softened more resilient plastic resin material at 22 which extends above the body of the extrusion to define a sealing flange 23.

Figure 1:
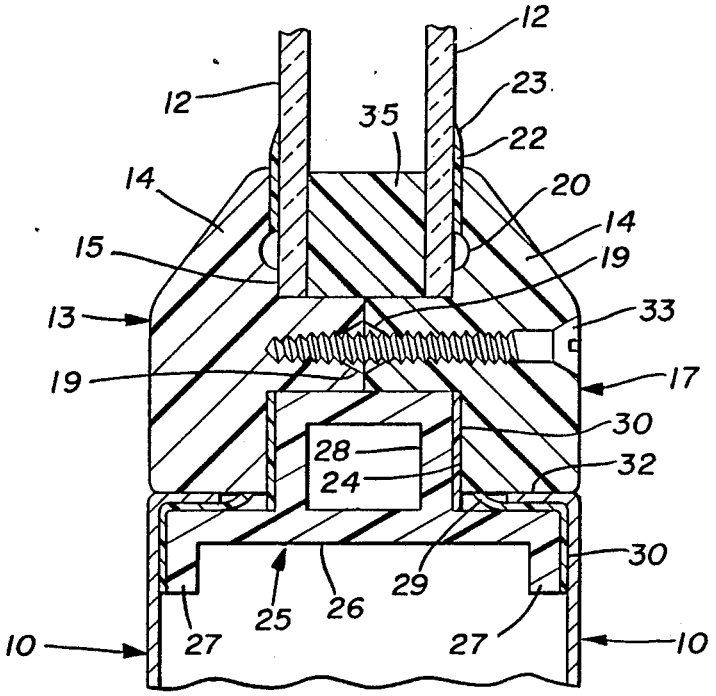
FIG. 1 is a cross-sectional view of a portion of a door light unit in a door.
Figure 2:
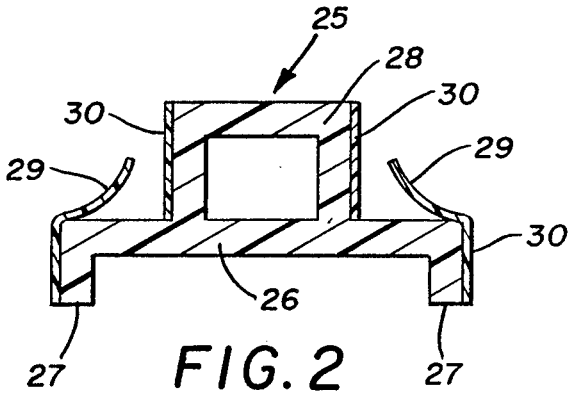
FIG. 2 is a cross-sectional view of a mounting extrusion.
Figure 3:
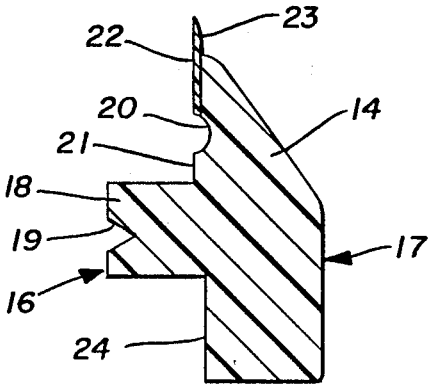
FIG. 3 is a cross-section of a glass mounting extrusion.

The outer surface 17 of the extrusion 14 is angularly disposed from the flange 23 to a point opposite said rib 16. The portion of the inner surface 16 extending below said alignment and fixation rib 18 defines in combination with the rib 18 a mounting channel 24 when the pair of extrusion members 14 are in abutting relationship to receive the window pane 12 as seen in FIG. 1 of the drawings. The mounting channel 24 is registrable on an inner bar extrusion 25 that can best be seen in FIG. 2 of the drawings comprising a horizontally disposed base portion 26 having oppositely disposed down-turned flanges 27 and a upstanding hollow body 28 positioned therebetween. A pair of oppositely disposed elongated arcuate flexible flanges 29 are formed by the dual durometer process of resilient resin and extend respectively from an integral extension of a resilient resin portion 30 on the outer facing surface of the down-turned flanges 27. The vertical extending surfaces of the upstanding hollow body 28 also have the resilient resin portion 30 thereon.

Referring now to FIG. 4 of the drawings the inner bar extrusion 25 can be seen for inclusion into the metal door 10 having a door light opening 31 therein and having inturned door flanges 32. Once assembled the door flanges 32 engage and compress the flexible flanges 29 on the inner bar extrusion 25 which in combination with the resilient outer facing surface portion 30 form an effective seal between the inner bar extrusion 25 and the door 10 around its door light opening 31.

During assembly the extrusion members 14 are positioned around one side of the glass pane 12 and inserted-into the door light opening 31 and abutting both the inner bar extrusion 25 and the inturned flange 32 of the door 10 whereby engaging the exposed portion of the elongated resilient flange 29 deflecting same.

Once positioned co-facing additional extrusion members 14 are inserted around the opposite side of the glass pane 12 engaging the insert bar extrusion 25 and the earlier positioned extrusion member 14. A plurality of screw type fasteners 33 are positioned in longitudinally spaced relation to each other through the adjoining extrusion members 14 from one side using the V-shaped grooves 19 for center alignment of the respective joined extrusion members 14.

As assembled the door light assembly 11 is securely held and aligned within the door light opening 31 by the multiple sided engagement on the inner bar extrusion 25 flush within the door light opening 31. Since the extrusion members 14 are flush within the door light opening 31 shipping and handling damage to same is greatly reduced, thus reducing overall production costs and increased production and delivery efficiency.

It will be apparent in the above described assembly that the screw fasteners 33 are inserted through pilot holes drilled through one of the abutting extrusions 14 and said screw fasteners 33 will engage and center on the other extrusion 14 by the alignment guide groove 19 hereinbefore described.

Caulking compound 34 is disposed within the groove 20 prior to assembly to assure a weather tight seal between the glass pane 12 and the extrusion 14. The sealing flange 23 also effects sealing relationship with the glass pane 12 by its flexible configuration that is integral with the outer surface 17 as hereinbefore described.

It should be noted that the glass pane 12 is typically of an insulating type dual pane configuration utilizing a air space between the glass panes and a sealing spacer 35 around the perimeter edge of the window pane 12 to form an insulated glass unit well known and understood in the art.

Thus it will be seen that a new and novel window mounting assembly for door lights and the like has been illustrated and described and that various changes and modifications may be made therein without departing from the spirit of the invention, therefore I claim:

1. A mounting assembly for a glass window pane in a receiving opening within a door comprises: a pair of identical extrusion members and an innerbar extrusion; both of said members being extruded plastic resin material; said identical extrusion members registrable together to form a glass receiving channel, and a mounting channel; said identical extrusion members having a fixation rib extending therefrom, means for sealing a portion of said identical extrusion members to said glass panel and means for securing said extrusion members together; said innerbar extrusion member comprising a base portion with oppositely disposed downturned flanges and an upstanding registration body member thereon; said innerbar extrusion member secured partially within and extending from said receiving opening; means for resiliently sealing said innerbar extrusion member within said receiving opening and against said identical extrusion members; said mounting channel engageable on said upstanding registration body; and identical extrusion members registrable together on said innerbar extrusion member.

2. The mounting assembly of claim 1 wherein said means for sealing a portion of said identical extrusion members to said glass pane comprises oppositely disposed caulking grooves within said identical extrusion members and a resilient sealing flange on a portion of said receiving channel.

3. The mounting assembly of claim 1 wherein said means for resiliently sealing said innerbar extrusion member within said receiving opening and against said identical extrusion members comprises upstanding curvilinear flanges of resilient material extending from said innerbar extrusion member and adjacent areas of resilient material on adjacent portion of said innerbar extrusion member.

4. The mounting assembly of claim 1 wherein said fixation rib extending from each of said identical extrusion members has an elongated longitudinally extending groove therein for transverse alignment of said means for securing said identical extrusion members together.

* * * * *